US007275398B2

(12) United States Patent
Kim et al.

(10) Patent No.: US 7,275,398 B2
(45) Date of Patent: Oct. 2, 2007

(54) WASHING MACHINE

(75) Inventors: Jong Seok Kim, Changwon-shi (KR); Yang Hwan No, Changwon-shi (KR); Han Ki Cho, Changwon-shi (KR); Yeon Su Jung, Changwon-shi (KR); Jung Hoon Kang, Changwon-shi (KR); Myung Sik Park, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 721 days.

(21) Appl. No.: 10/720,543

(22) Filed: Nov. 25, 2003

(65) Prior Publication Data

US 2004/0168484 A1 Sep. 2, 2004

(30) Foreign Application Priority Data

Nov. 28, 2002 (KR) ..... 10-2002-0074961
Nov. 28, 2002 (KR) ..... 10-2002-0075023
Nov. 28, 2002 (KR) ..... 10-2002-0075025
Nov. 28, 2002 (KR) ..... 10-2002-0075026
Nov. 28, 2002 (KR) ..... 10-2002-0075027

(51) Int. Cl.
*D06F 37/26* (2006.01)

(52) U.S. Cl. ..... 68/3 R; 68/23 R; 312/228

(58) Field of Classification Search ..... 312/228, 312/228.1; 68/3 R, 23 R, 24, 58, 139, 142
See application file for complete search history.

(56) References Cited

U.S. PATENT DOCUMENTS 2,174,107 A * 9/1939 Kenney ..... 361/814
4,307,588 A * 12/1981 Smith et al. ..... 68/23.7
4,618,193 A 10/1986 Cuthbert et al.
4,840,285 A 6/1989 Carr
5,557,827 A * 9/1996 Lautenschlager et al. ..... 16/237
5,584,549 A 12/1996 Lybarger et al.
2002/0190617 A1* 12/2002 Banicevic et al. ..... 312/321.5

FOREIGN PATENT DOCUMENTS

| | | | |
|---|---|---|---|
| CN | 2424219 | | 3/2001 |
| DE | 2840939 | | 6/1979 |
| DE | 19708739 | A1 | 9/1998 |
| DE | 19828333 | A1 | 12/1999 |
| DE | 10101217 | A1 | 7/2002 |
| EP | 0588100 | A1 | 3/1994 |
| GB | 2 022 621 | A | 12/1978 |
| GB | 2071706 | A | 9/1981 |

(Continued)

*Primary Examiner*—Joseph L. Perrin
(74) *Attorney, Agent, or Firm*—McKenna, Long & Aldridge LLP

(57) ABSTRACT

Washing machine including a washing tub having an inner tub rotatably mounted for holding and washing laundry, and an outer tub having the inner tub mounted therein, a driving device for rotating the inner tub, a body having a base plate, one pair of side panels at opposite side edges of the base plate, a rear panel at rear edges of the base plate and the side panels, and a top panel on top of the side panels and rear panel, and the washing tub and the driving device held therein, and a front panel rotatably engaged with, supported on, and detachably mounted on, a front part of the body, thereby permitting easy and fast assembly/disassembly of the cabinet.

38 Claims, 10 Drawing Sheets

FOREIGN PATENT DOCUMENTS

| | | |
|---|---|---|
| JP | 52-121545 | 4/1979 |
| JP | 55-158096 | 12/1980 |
| JP | 56-095741 | 1/1983 |
| JP | 58-118795 | 7/1983 |
| JP | 09-024190 | 1/1997 |

* cited by examiner

WASHING MACHINE

This application claims the benefit of the Korean Application Nos. P2002-0074961, P2002-0075023, P2002-0075025, P2002-0075026, and P2002-0075027, all of which were filed on Nov. 28, 2002, and are hereby incorporated by reference.

BACKGROUND OF THE INVENTION

1. Field of the Invention

The present invention relates to washing machines, and more particularly, to a washing machine of a structure of which assemblability is improved.

2. Background of the Related Art

In general, the washing machine washes laundry with actions of detergents and water in a tub by washing, rinsing spinning cycles for removing contaminants stuck to clothes and beddings in a drum rotating inside of the tub.

The cabinet, forming an outer part of the washing machine, holds various components therein, including sensitive electronic components, and mechanical components for carrying out different motions. For an example, in the cabinet, there are the tub rotating at a fast speed, and an electronic controller for controlling the rotation of the tub. Moreover, the cabinet protects the electronic components and the mechanical components from an external physical impact, and the user from moving mechanical components.

In general, the cabinet has a plurality of panels that have required strengths, and are assembled together. In general, for assembly of the panels, the panels have flanges at edges for fastening to each other with fastening members, such as screws.

Referring to FIG. 1, a related art washing machine is provided with one pair of side panels 12, and a rear panel (not shown), to surround both sides and rear of a tub 20 on a base plate 11, and a top panel 13 on the panels to cover a top of the tub 20.

There are an upper plate 14, and a lower plate 15 joined to an upper part and a lower part of the side panels respectively for reinforcing strength, and there is a front panel 40 joined to front edges of the base plate 11, the one pair of the side panels 12, and the top panel 13.

In more detail, opposite side parts of an upper part and lower part of the front panel 40 are fastened to the upper plate 14 and the lower plate 15 with fastening means, respectively. That is, in the opposite side parts of the upper plate 14 and the lower plate 15, there are first fastening holes 14*a*, 14*b*, 15*a*, and 15*b* for fastening the front panel 40 thereto with fastening means 51, 52, 53, and 54 respectively, and there are second fastening holes 41, 42, 43, and 44 in opposite side parts of the upper part and lower part of the front panel in correspondence to the first fastening holes 14*a*, 14*b*, 15*a*, and 15*b*.

According to above configuration, the front panel 40 is fastened as the fastening means 51, 52, 53, and 54 are inserted in, and fastened to, the first and second fastening holes.

The related art washing machine requires to align the upper part second fastening holes 41 and 42 in the front panel 40 with the first fastening holes 14*a* and 14*b* in the upper plate 34, and the lower part second fastening holes 43 and 44 in the front panel 40 with the first fastening holes 15*a* and 15*b* in the lower plate 36, before inserting and fastening the fastening means 41, 42, 43, and 44.

Because of above structure, the cabinet of the related art washing machine has problem in that assembly and disassembly of the cabinet is not convenient, to require a substantial time period. Moreover, as a size of the washing machine becomes the larger, since the front panel also becomes the heavier, it is liable to cause accident.

To cope with the problems, development of a washing machine having a cabinet of which assembly and disassembly is easy, and can be carried out within a short time period has been required.

SUMMARY OF THE INVENTION

Accordingly, the present invention is directed to a washing machine that substantially obviates one or more of the problems due to limitations and disadvantages of the related art.

An object of the present invention is to provide a washing machine having a cabinet of which assembly and disassembly is simple and fast.

Other object of the present invention is to provide a washing machine with a reinforced cabinet.

Another object of the present invention is to provide a washing machine having a cabinet of a structure which permits easy arrangements of internal wiring, and water circulating hoses.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the washing machine includes a washing tub having an inner tub rotatably mounted for holding and washing laundry, and an outer tub having the inner tub mounted therein, a driving device for rotating the inner tub, a body having a base plate, one pair of side panels at opposite side edges of the base plate, a rear panel at rear edges of the base plate and the side panels, and a top panel on top of the side panels and rear panel, and the washing tub and the driving device held therein, and a front panel rotatably engaged with, supported on, and detachably mounted on, a front part of the body.

The front panel is engaged with the body such that the front panel is rotatable around one edge thereof.

The body or the front panel includes rotating means for holding the one edge of the front panel to prevent the one edge from breaking away, and making the front panel rotatable around the one edge in mounting of the front panel.

In more detail, the front panel is engaged with a lower edge of the front part of the body such that the front panel is rotatable around the lower edge.

The body includes at least one catching device for holding the lower edge of the front panel to prevent the lower edge from breaking away, and supporting the front panel rotatable around the lower edge in mounting of the front panel.

The catching means includes a slot for preventing the lower edge of the front panel from breaking away toward front or below the body.

In more detail, the catching device includes a length of forward projection from the body, and an upward bend part at an end of the projection.

The body further includes a supporting part under each of the catching devices, in more detail, projected forward from the body.

The front panel further includes slots each having a width and a length for inserting in the upward bend part on each of the catching devices.

The front panel further includes a horizontal bend part bent backward from the lower edge having the slots formed therein, and a vertical bend part extended upward vertically from an end of the horizontal bend part.

The body further includes at least one projection extended forward from a lower part thereof for guiding and holding an upper edge of the vertical bend part when the front panel is mounted on the body.

The body further includes a lower reinforcing plate.

The catching devices and the projections on the body are formed at, and projected forward from, the lower reinforcing plate.

The body further includes forward projections from an upper part thereof, and the front panel further includes slots in a rear surface of a top end thereof in correspondence to the projections.

The front panel further includes fastening means for fastening the projections.

Preferably, the body further includes an upper reinforcing plate mounted on the upper part of the front part thereof, and the projections of the body are projected forward from the upper reinforcing plate.

One of the one pair of the side panels includes a groove formed along a front edge thereof for receiving different wires and a circulating hose of washing water of the washing machine.

The front panel includes fluidity prevention means for guiding the front panel to a required position in the front part of the body, and fastened to the body after the front panel is mounted on the body, when the front panel is rotatably engaged with the body, and mounted on the front part of the body by rotating the front panel.

Each of the side panels includes a guide part projected backward from a part of the front edge in correspondence to the fluidity prevention means.

The front panel includes side flanges formed by bending opposite edges to have openings toward a central part, and a reinforcing bracket fixed to the side flanges.

Also, the front panel includes upper, and lower flanges respectively having upper edge and lower edge bent to have openings in a central direction, and reinforcing beads formed at least one of the upper and lower flanges.

Thus, the foregoing washing machine cabinet permits easy and fast assembly/disassembly of the washing machine, and improve strength of the cabinet.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, identical parts will be given the same names and reference symbols, and repetitive description of which will be omitted.

Figure 1:
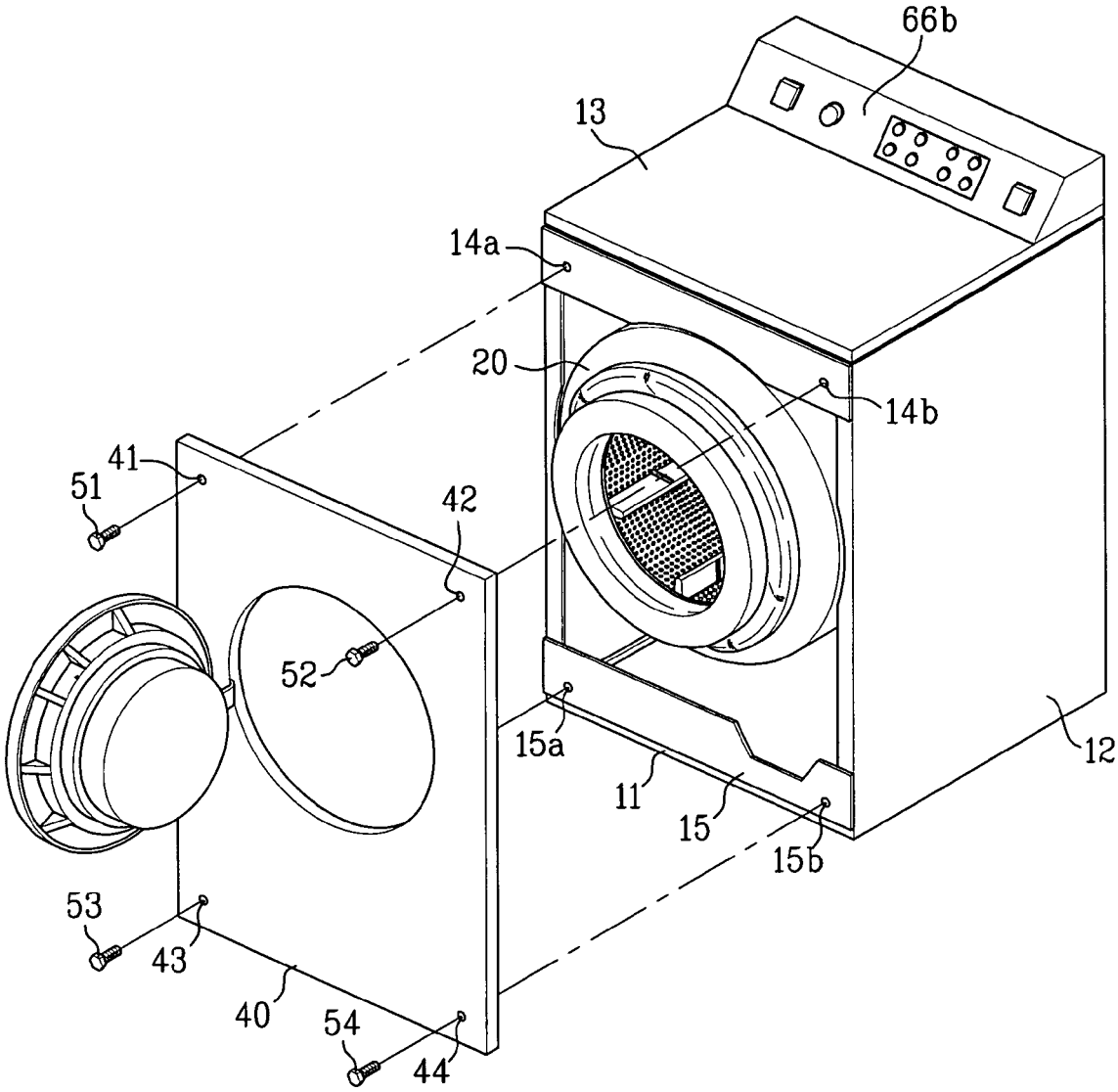
FIG. 1 illustrates a perspective view of a related art washing machine, with a front panel of a cabinet thereof dismounted therefrom.
Figure 2:
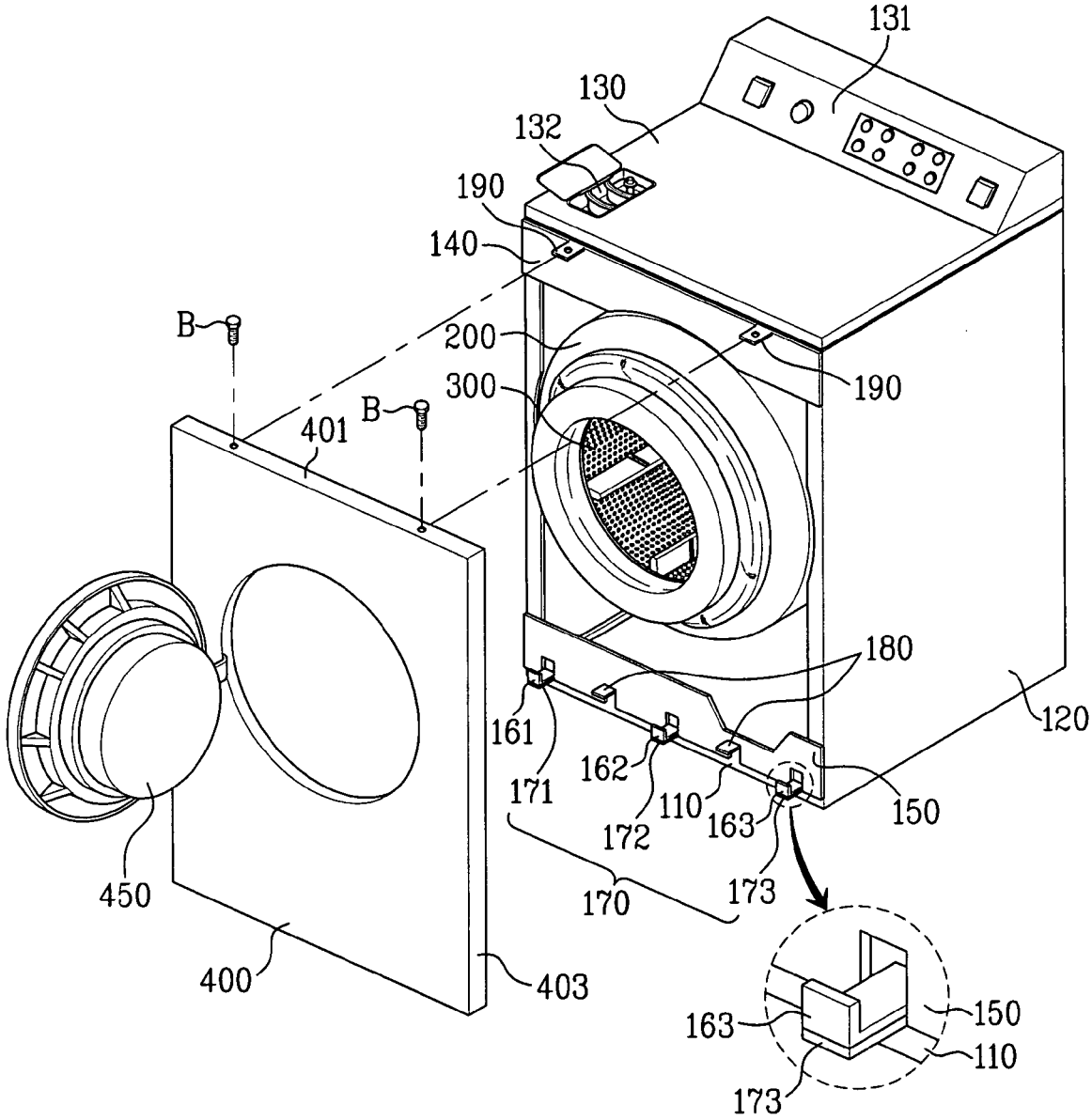
FIG. 2 illustrates a perspective view of a washing machine in accordance with a preferred embodiment of the present invention, with a front panel of a cabinet thereof dismounted therefrom.
Figure 3:
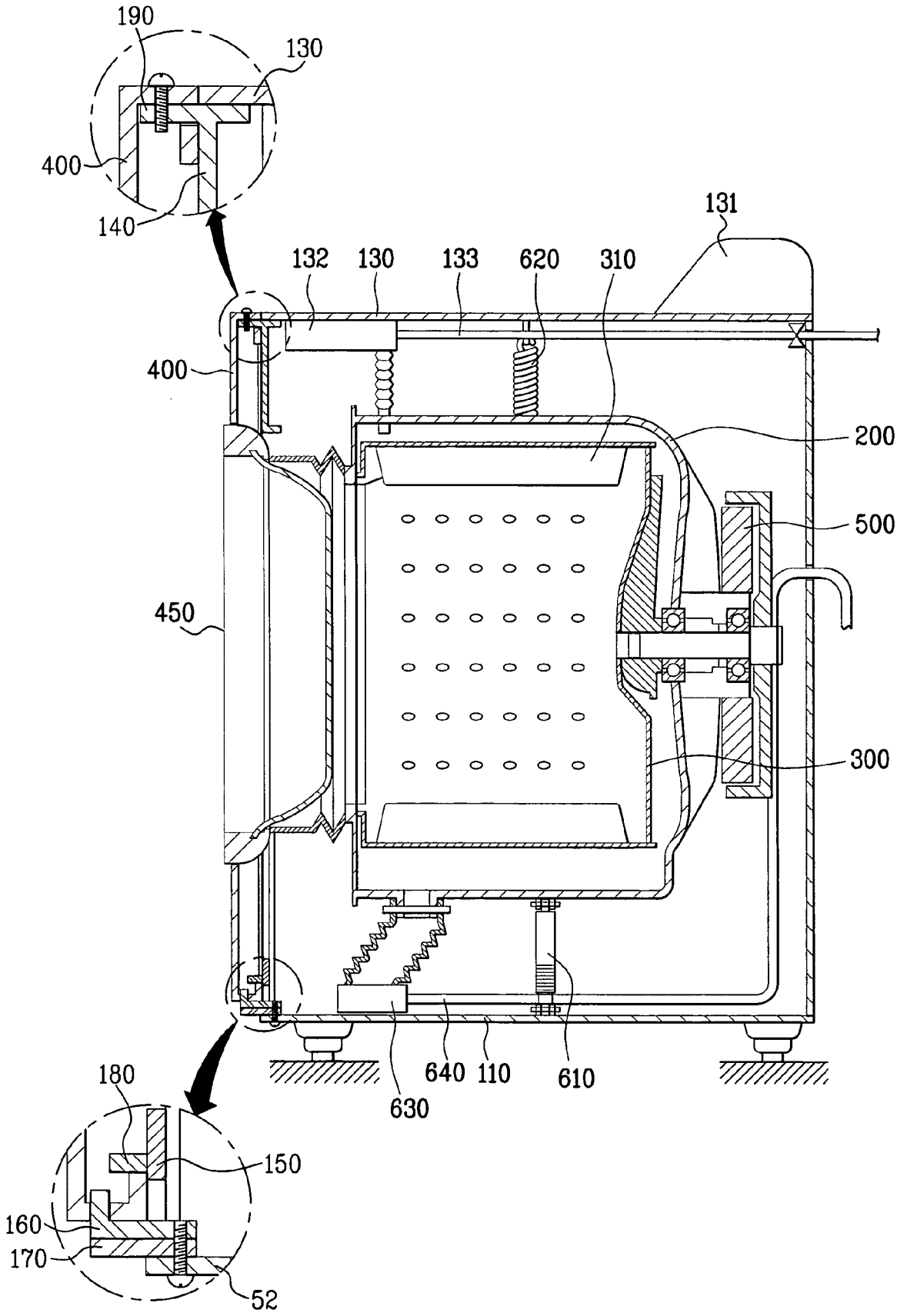
FIG. 3 illustrates a perspective view showing an inside of a washing machine in accordance with a preferred embodiment of the present invention.
Figure 4:
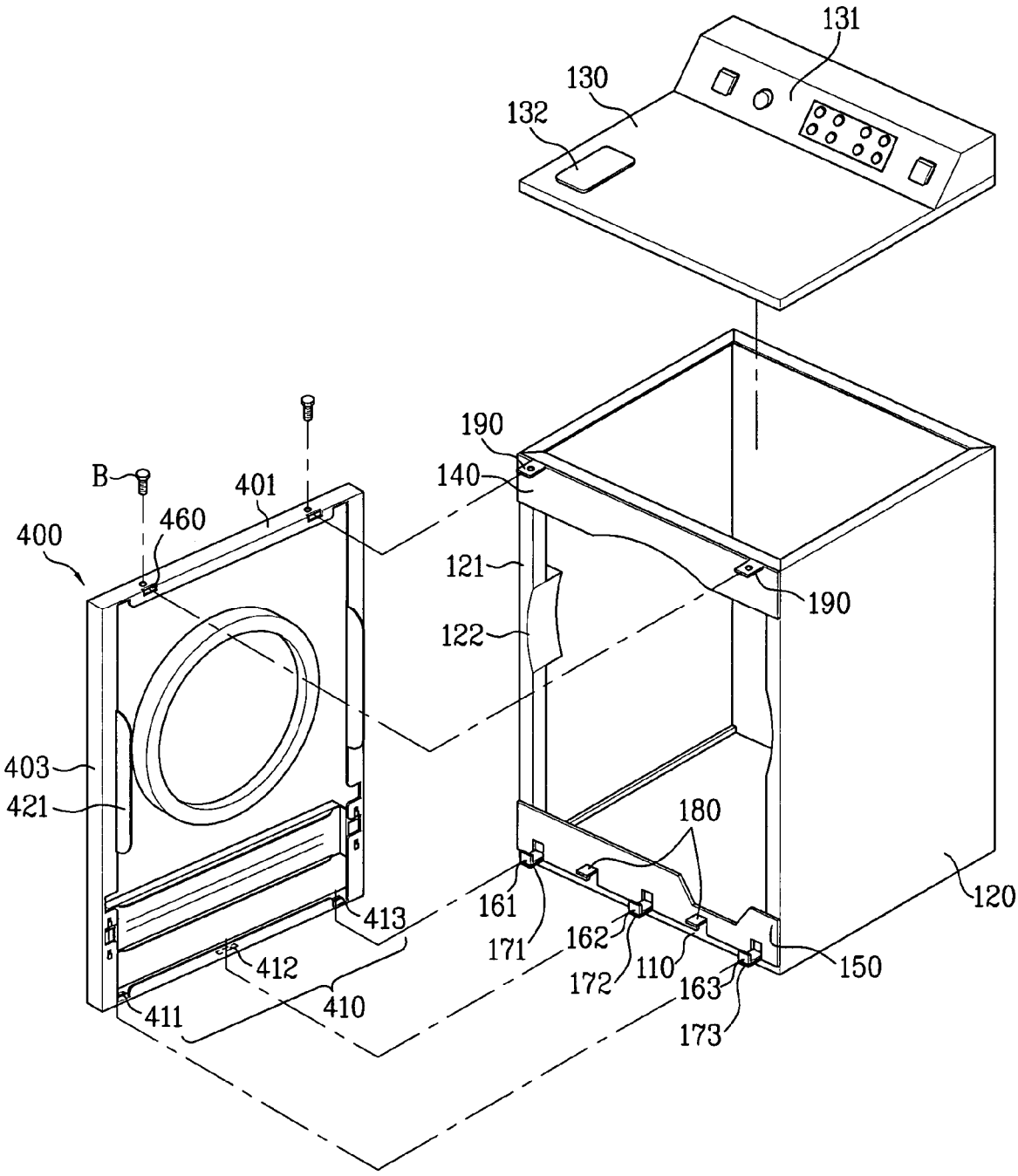
FIG. 4 illustrates a perspective view showing a cabinet separated from a washing machine of the present invention.

FIG. 2 illustrates a perspective view of a washing machine in accordance with a preferred embodiment of the present invention, with a front panel of a cabinet thereof dismounted therefrom, FIG. 3 illustrates a perspective view showing an inside of a washing machine in accordance with a preferred embodiment of the present invention, and FIG. 4 illustrates a perspective view showing a cabinet separated from a washing machine of the present invention.

Referring to FIGS. 2 to 4, an outer part of the washing machine includes a base plate 110, side panels 120, a top panel 130, a rear panel 140, and a front panel 400, assembled together on the whole. The base plate 110, the side panels 120, the rear panel 140, and the top panel 130 form a body 100 of a washing machine cabinet.

One pair of the side panels 120 are mounted on opposite edges of the base plate 110 which forms a bottom of the cabinet. The rear panel 140 is mounted on a rear edge of the base plate 110. The top panel 130 is mounted on top edges of the side panels and rear panel. The top panel may be provided with a control panel 131 for operation of the washing machine, and a detergent box 132 for holding detergent.

Referring to FIG. 2, though the control panel 131 is mounted on top of the top panel, a position of the control panel 131 may be changed. For an example, the control panel may be mounted on an upper part of a front surface of the front panel. The front panel 400, mounted on an opened front part of the body 100 of the base plate 110, the side panels 120, the rear panel 140, and the top panel 130, forms a front face of the washing machine.

Basically, the cabinet forms a space for holding major components of a home appliance, such as the washing machine, for protecting the components. In the cabinet, there is a washing tub configured to wash laundry, and a driving device 500 for rotating the washing tub. In general, the washing tub includes a tub for preliminary storage of washing water, and a drum in the tub. In more detail, the tub is called as an outer tub 200, and the drum is called as an inner tub 300 rotatably mounted in the outer tub.

In an upper part of an inside of the cabinet, there are a water supply hose 133 and a water supply valve (not shown) for supplying washing water into the outer tub 200, and in a lower part of the outer tub 200, there are a discharge pump 630 for circulating or discharging the washing water, and a drain hose 640. For absorbing, and damping vibration of the outer tub 200, there is a damper between the outer tub and the base plate 110, and a spring 620 between the outer tub and the top panel 130.

In the meantime, the laundry is introduced into the washing tub through the door on the front panel, and washed and extracted of water as the washing tub, more specifically, the inner tub 300 rotates.

In the meantime, the door may be mounted on the front panel or the top panel depending on arrangements of inner components, particularly, the washing tub. As shown in FIGS. 2 to 5, if the washing tub is arranged in a laid down position, the door is arranged on the front panel, which is so called "front loading type washing machine".

In the foregoing cabinet, after the front panel 400 is rotatably engaged with one side of a front of the body 100, the front panel 400 is detachably supported on the front part of the body 100. In more detail, the front panel may be configured such that the front panel is rotatably engaged with a lower edge of the body.

To do this, the lower edge of the body 100 has catching devices 160 for holding a lower edge of the front panel, for preventing the lower edge of the front panel from breaking away toward front or below the body.

The catching device may be fitted symmetry with respect to a center of the lower edge of the body. For an example, the catching device may be arranged at positions having distances equal to the center of the lower edge of the body, or one of the catching device is arranged at the center, and same number of the catching device may be arranged at equal distances from the center.

In more detail, each of the catching device 161, 162, and 163 includes a length of forward projection from the body, having an upward bend at a fore end thereof, to form a slot facing upward. The catching devices are provided to the center, and left and right side part of the body, called as, starting from left, a first catching device 161, a second catching device 162, and a third catching device 163.

It is preferable that the body further includes a supporting part 170 under each of the catching devices 160. Since it is liable that the catching device is hung down or damaged from deformation caused by a load of the front panel, the supporting part is arranged for preventing deformation of the catching device.

Figure 6:
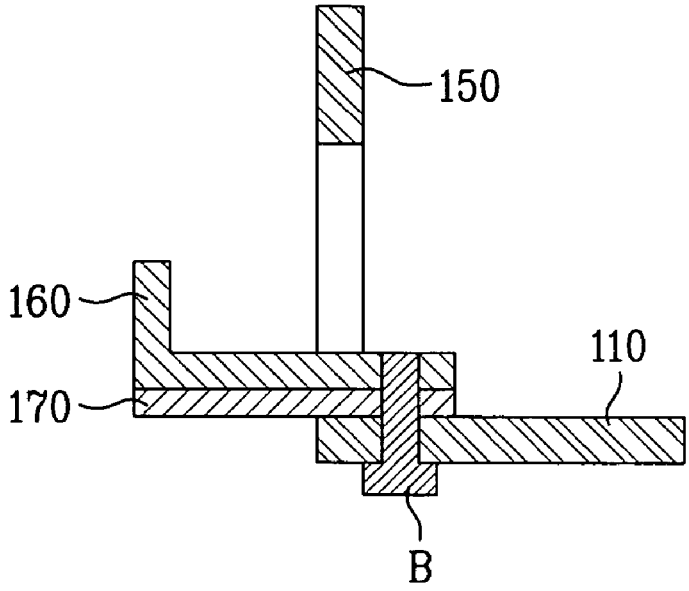
FIG. 6 illustrates an enlarged view of one embodiment of catching device and a support part on a cabinet body for a washing machine of the present invention.

Referring to FIGS. 4 and 6, the supporting part is projected forward to support a bottom of the catching device 161, 162, or 163. For this, the supporting part 170 includes a supporting projection 171, 172, or 173.

In the meantime, the front panel 400 has flanges at upper, lower edges, and side edges thereof each bent backward from the edge and, therefrom bent inwardly. The front panel 400 includes an upper flange 401 at the upper edge, a lower flange 402 at the lower edge, and side flanges 403 at opposite edges.

There are slots 410 each having a width and a length in the lower flange for inserting the upward bend part of the catching device therein, so that, when the front panel 400 is mounted on the front part of the body, a lower end of the front panel 400 is engaged with the catching device 160 on the lower part of the body, and a top end of the front panel 400 is engaged with the body as the front panel rotates around the lower end toward the front of the body.

In more detail, of the horizontal bend part bent backward from the lower edge of the front panel, and the vertical bend part bent upward from an end of the horizontal bend part of the lower flange 402, the slots 410 are formed in the horizontal bend part, including a first slot 411 corresponding to the first catching device 161, a second slot 412 corresponding of the second catching device 162, and a third slot 413 corresponding to the third catching device 163.

Different from above configuration, the lower flange of the front panel may be seated on the slot in the catching device. It can be noted that, in this case, no slots in the lower flange are required. Meanwhile, the catching device may be form not only on the lower part of the body, but also upper part or opposite parts thereof. In this case, positions and forms of the slots in the flange may be changed, accordingly. It can also be noted that the catching device can be formed on the flange on the front panel. In this case, the slot is formed in the body. The catching device and the slot are rotating means for holding one end of the front panel so as not to break away from the front part of the body as well as rotating around the one end.

The body further includes at least one projection 180 extended forward from the lower edge of the body, for guiding an upper edge of the vertical bend part when the front panel is mounted on the body.

In the meantime, the body 100 includes a lower reinforcing plate 150 at a lower part of the front of the body 100 for reinforcing the lower part of the body.

It is preferable that the lower reinforcing plate 150 is fastened to opposite side parts of the lower part of the front part of the body with fastening means, such as screws, and has a channel section for enhancing strength.

If the lower reinforcing plate 150 is provided, the catching devices 160 and projections 180 on the body are projected forward from a lower edge of the lower reinforcing plate 150. Or, as shown in FIG. 3, the catching devices and the projections on the body may be formed by cutting and bending the lower reinforcing plate 150.

Figure 7:
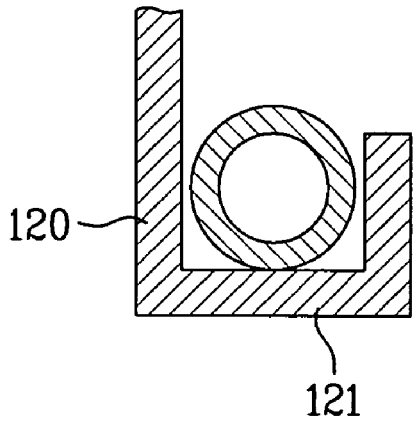
FIG. 7 illustrates a diagram of one embodiment of receiving means on a cabinet body for a washing machine of the present invention.

Referring to FIG. 7, the body may include a groove 121 for putting various wires and a water circulating hose of washing water for the washing machine thereon, formed along a front edge of one of the side panels 120. The groove 121 may be formed by bending one of the side panels 120 backward to open a rear side. In more detail, as shown in FIG. 7, the groove 121 is formed to have a horizontal channel section by bending a front edge of the side panel inward for two times, i.e., by bending the front edge of the side panel toward the opened part of the body, and therefrom toward the rear panel 140 of the body. The annular section in the groove 121 in FIG. 7 represents a circulating hose.

There are forward projections 190 from the upper part of the body for fastening the upper part of the front panel 400 to the upper part of the body, there are slots 460 in a rear surface of the upper flange of the front panel. When the projections 190 are respectively inserted in the slots 460, the projections are fastened with fastening means, such as screws 'B'.

There is an upper reinforcing plate 140 at the upper part of the front part of the body 100, and the projections 190 are projected forward from an upper edge of the upper reinforcing plate.

In the present invention, the projections 190 are provided to a center, and left and right side parts of the upper part of the body, and called as, starting from left side, a first projection, a second projection. The slots 450 are called as a first slot in correspondence to the first projection on the body, and a second slot in correspondence to the second projection.

It is preferable that the opposite side parts of the upper plate 140 are fastened to the opposite side parts of the upper front part of the body with fastening means, such as screws, and the upper plate 140 has a channel section for enhancing strength.

Figure 8:
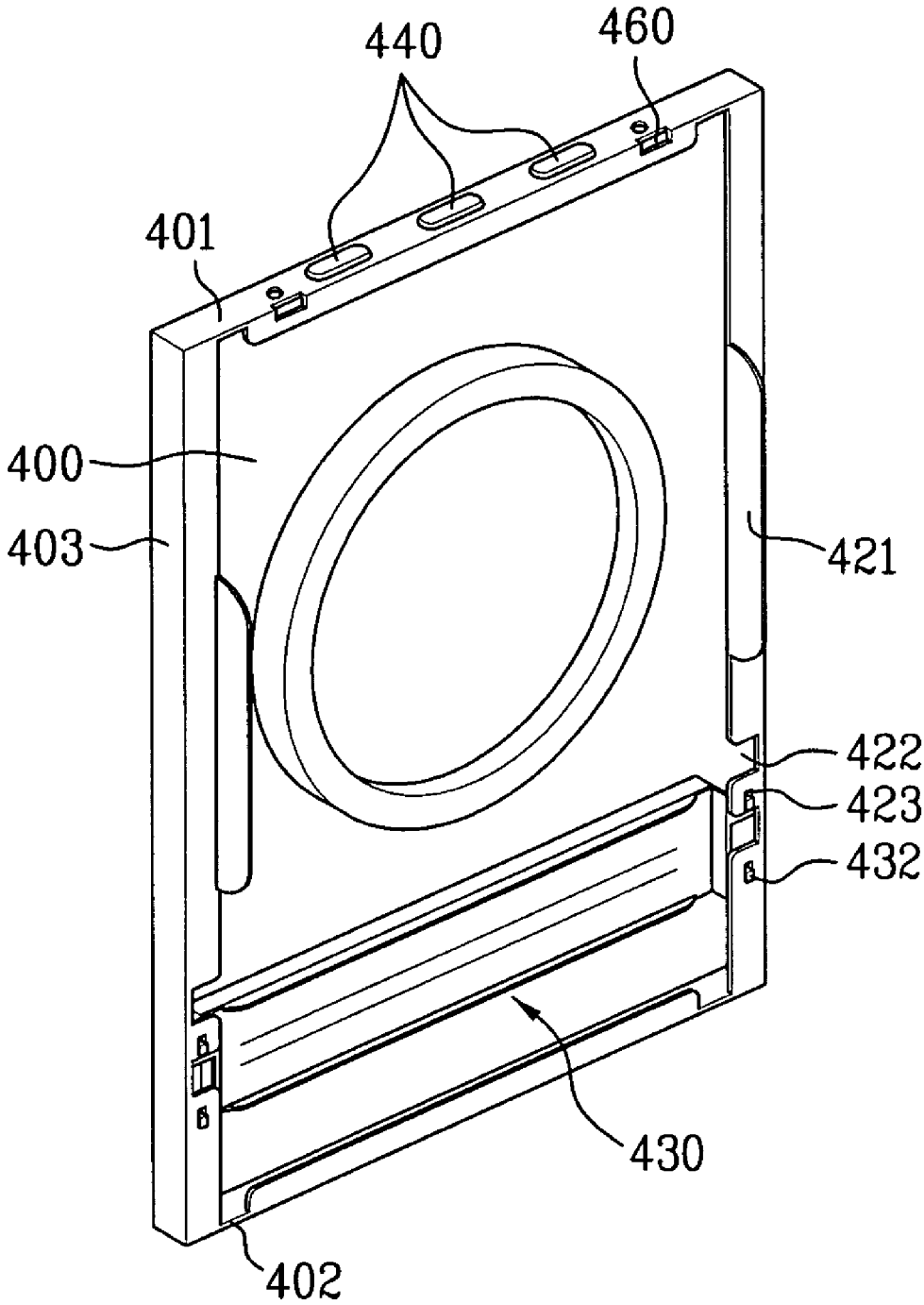
FIG. 8 illustrates a perspective back view of a front panel for a washing machine of the present invention.

Referring to FIGS. 4 and 8, the front panel 400 includes fluidity prevention means 421 for guiding the front panel to a required position of the front part of the body, and fastening the front panel to the body more positively after the front panel 400 is mounted on the body, when the front panel 400 is rotatably engaged with the catching means 160 on the body, and mounted on the front part of the body by rotating the front panel 400. The fluidity prevention means 421 is projected backward from the side flanges 403.

There are guide parts 122 projected backward from the front edges of the side panels 120 in correspondence to the fluidity prevention means 421. There is at least one reinforcing bead 440 on the upper flange of the front panel 400 for reinforcing strength of the upper flange. It is preferable that the reinforcing beads 440 are provided to the lower flange 402, too.

In addition to above structure, the front panel 400 may further include reinforcing bracket 430 fixed to the side flanges 403. The bracket 430, reinforcing the front panel 400 for preventing deformation caused by vibration and the like, has at least one first projection 431 at each of opposite ends for fastening to the side flanges 403 of the front panel.

The side flange 403 has a cut away part 422 for passing the first projection 431 of the reinforcing bracket 430, and a fastening hole 423 on an upper side or a lower side of the cut away part 422 for fastening the first projection 431 of the bracket. For fastening the reinforcing bracket, there is a second projection 432 projected backward from the first projection 431. The reinforcing bracket 430 is fixed as the second projection 432 is inserted in the fastening hole 423 in the side flange 403. The bracket 430 may be fixed, not by means of the second projection 432, but by other fastening means (not shown), such as screws.

In the case the bracket 430 is fixed with screws, it is preferable that the screw is not projected from a rear surface of the side flange 403 after the screw is fastened, fully. This is for closer tightening of the front panel 400 to the body 100. For this, it is preferable that there is a depth of recess (not shown) around the fastening hole 423, and the bracket 430 is fastened with a flat head screw.

It is preferable that the front panel further includes an elastic member between a rear surface thereof and the reinforcing bracket for preventing vibration of the bracket when the washing machine is in operation. The elastic member may be formed of sponge or rubber.

A process for mounting the reinforcing bracket 430 on the front panel 400 will be described with reference to FIGS. 9B and 9C.

Figure 9A:
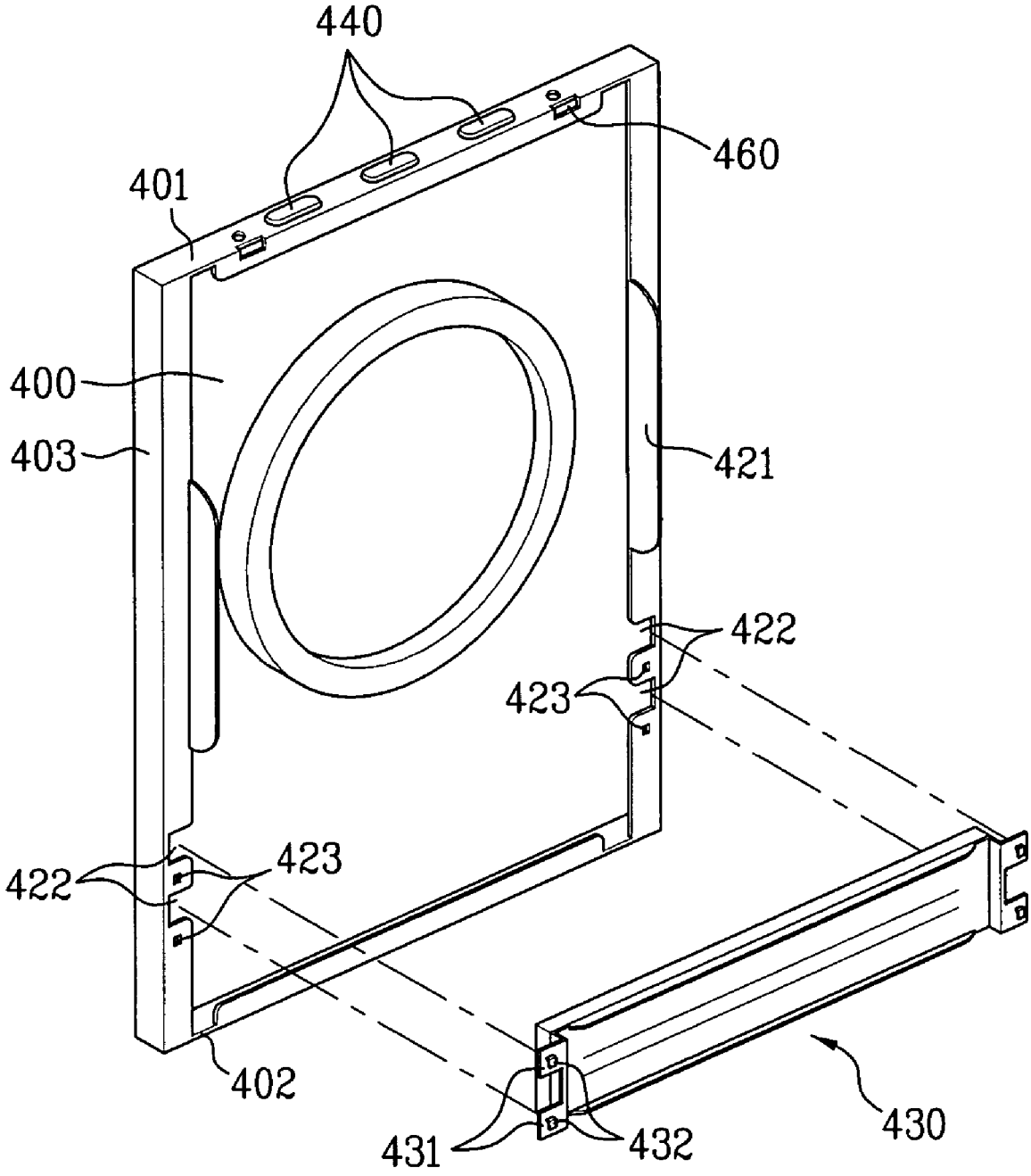
FIGS. 9A to 9C illustrate perspective views and a mounting process of a reinforcing bracket for a front panel of a cabinet for a washing machine of the present invention.
Figure 9B:
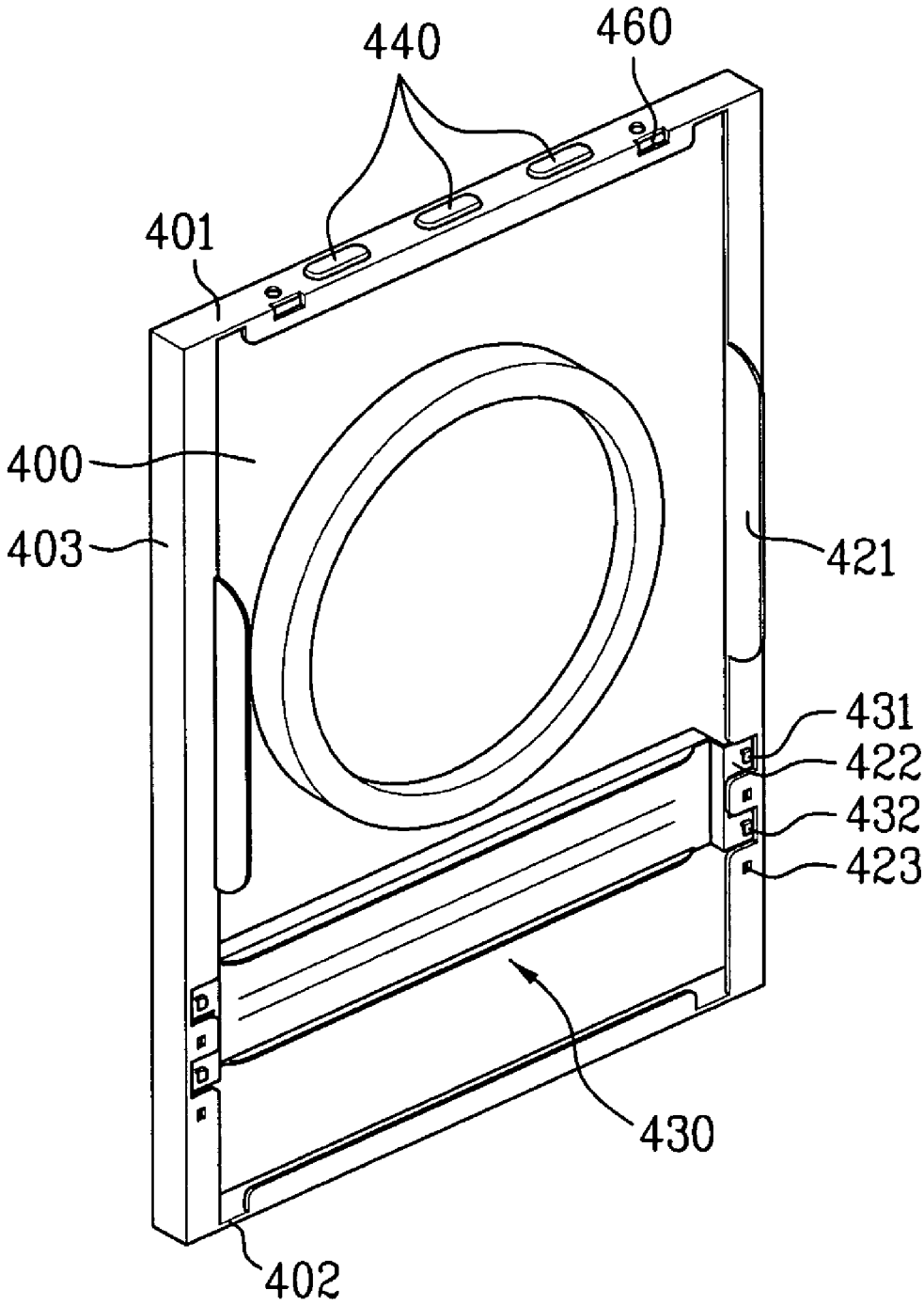

Referring to FIG. 9B, the first projection 431 of the bracket is passed through the cut away part 422 in the side flange 403, to position the first projection 431 in the side flange.

Figure 9C:
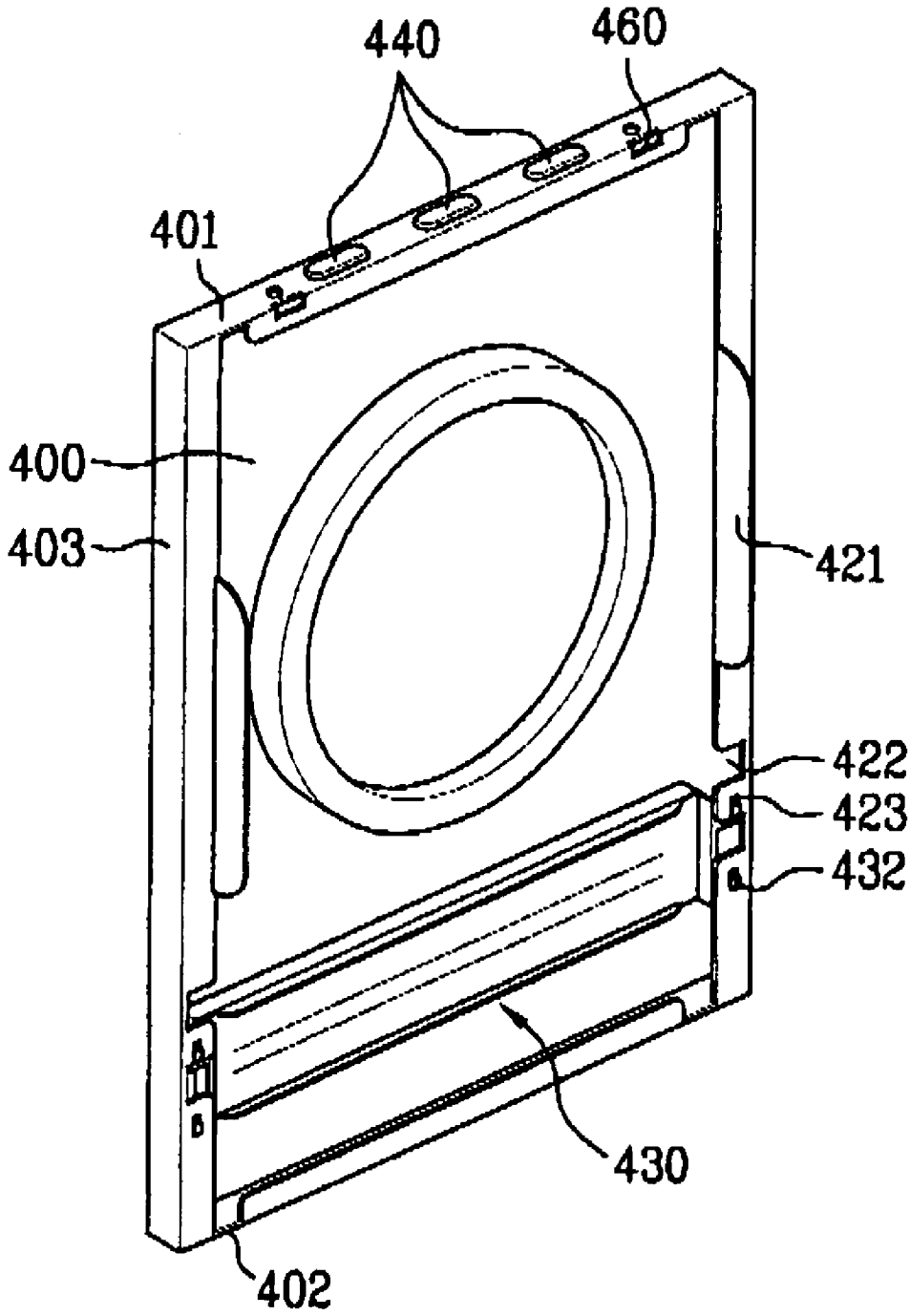

Then, referring to FIG. 9C, the bracket 430 is moved down, and the second projection 432 is inserted in the fastening hole 423, thereby finishing mounting of the bracket.

According to a foregoing configuration, the washing machine cabinet can be assembled/disassembled more readily and quickly. A process for assembling the cabinet will be described in detail, with reference to the attached drawings.

For forming a basic frame for a space to hold various components, such as a washing tub, therein, at first, a body having a base plate 110, side panels 120, a rear panel 140, and a top panel 130 with a control panel 131 formed thereon is assembled with different fastening means.

In the space of the body assembled thus, various components are arranged. For an example, an inner tub 300, an outer tub 200, and driving means for rotating the inner tub 300 and the outer tub 200 are arranged in the space. Then, the circulating hose of washing water is put into the groove 121 formed along the front edge of the side panel.

After arranging various components inside of the body, the front panel 400 is mounted on front parts of the base plate, side panels, and top panel of the body. Of course, different from the foregoing process, the assembly may be carried out by a method in which the top panel is mounted, finally.

A process for mounting the front panel to the front part of the body will be described, in more detail.

Figure 5:
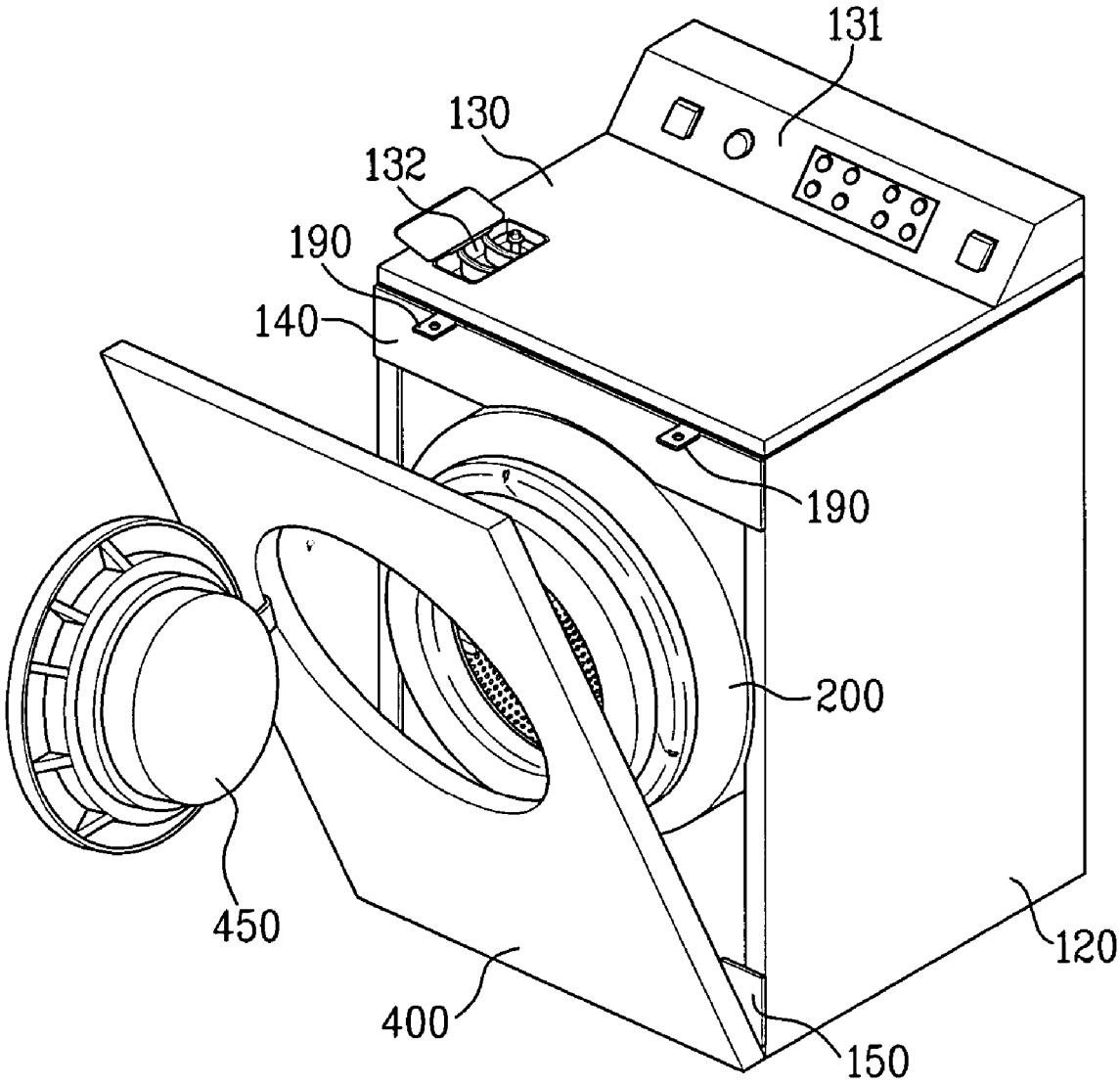
FIG. 5 illustrates a perspective view of an initial state of cabinet mounting in which a front panel of the cabinet is held at catching device on a cabinet body for a washing machine of the present invention.

Referring to FIG. 5, the first slot 411, the second slot 412, and the third slot 413 of the slots 410 in the front panel are inserted in the catching devices 160, respectively. As described before, the catching device 160 includes a first catching device 161 corresponding to the first slot 411, a second catching device 162 corresponding to the second slot 412, and a third catching device 163 corresponding to the first slot 413, formed on the lower reinforcing plate 150.

Once the projections 161, 162, and 163 are inserted in the slots 411, 412, and 413 in the front panel respectively, the worker can rotate the front panel 400 toward the body 100 around a lower end thereof without putting a great effort. If the front panel 400 moves toward the body around the lower end, the fluidity prevention means 421 on the side flanges 403 are guided by the guide parts 121 on the side panels, thereby preventing left/right direction fluidity of the front panel.

As the front panel is guided to a desired position of the body by the fluidity prevention means 421 until the upper part of the front panel comes into contact with the upper part of the body. If the front panel 400 is positioned at a right position of the front part of the body 100, the projections 190 on the upper part of the body are inserted in the slots 460 in the upper part of the front panel, respectively. Once the projections are inserted in the slots respectively, the projections are fastened with fastening means, such as screws. According to this, the front panel is mounted on the front part of the body, to form the washing machine cabinet.

As known, the cabinet varies with kinds of home appliances only, in general, with respect to sizes and forms. Accordingly, though the present invention has been described with respect to embodiments applied to the washing machine for convenience of description, the present invention is applicable to other home appliances.

The washing machine of the present invention has the following advantages.

First, assembly/disassembly of the washing water cabinet can be made more readily and quickly, to improve a productivity, to make maintenance simple, and to reduce hazard in handling heavy members by the worker.

Second, strength of the washing water cabinet is enhanced, to reduce deformation, or damage caused by gravity or vibration.

Third, the groove for placing the circulating hose, and the like permits easy arrangement of the components.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A washing machine comprising:

a washing tub having an inner tub rotatably mounted for holding and washing laundry, and an outer tub having the inner tub mounted therein;

a driving device for rotating the inner tub;

a body having a base plate, one pair of side panels at opposite side edges of the base plate, a rear panel at rear edges of the base plate and the side panels, and a top panel on top of the side panels and rear panel, and the washing tub and the driving device held therein, and projections projected forward from an upper reinforcing plate mounted on the upper part of a front part thereof; and a front panel rotatably engaged with a lower edge of the front part of the body, and detachably mounted on, the front part of the body and including slots in a rear surface of a top end thereof in correspondence to the projections.

2. The washing machine as claimed in claim 1, wherein the front panel is engaged with the body such that the front panel is rotatable around one edge thereof.

3. The washing machine as claimed in claim 2, wherein the body or the front panel includes rotating means-for holding the one edge of the front panel to prevent the one edge from breaking away, and making the front panel rotatable around the one edge in mounting of the front panel.

4. The washing machine as claimed in claim 1, wherein the front panel is rotatable around the lower edge.

5. The washing machine as claimed in claim 4, wherein the body or the front panel includes rotating means for holding the lower edge of the front panel to prevent the lower edge from breaking away, and making the front panel rotatable around the lower edge in mounting of the front panel.

6. The washing machine as claimed in claim 4, wherein the body includes at least one catching device for holding the lower edge of the front panel to prevent the lower edge from breaking away, and supporting the front panel rotatable around the lower edge in mounting of the front panel.

7. The washing machine as claimed in claim 6, wherein the at least one catching devices are arranged symmetrically with respect to a center of the lower edge of the body.

8. The washing machine as claimed in claim 7, wherein the catching means includes a slot for preventing the lower edge of the front panel from breaking away toward front or below the body.

9. The washing machine as claimed in claim 8, wherein the catching device includes a length of forward projection from the body, and an upward bend part at an end of the projection.

10. The washing machine as claimed in claim 9, wherein the front panel further includes slots each having a width and a length for inserting in the upward bend part on each of the catching devices.

11. The washing machine as claimed in claim 10, wherein the front panel further includes;

a horizontal bend part bent backward from the lower edge having the slots formed therein, and a vertical bend part extended upward vertically from an end of the horizontal bend part.

12. The washing machine as claimed in claim 11, wherein the body further includes at least one projection extended forward from a lower part thereof for guiding and holding a upper edge of the vertical bend part when the front panel is mounted on the body.

13. The washing machine as claimed in claim 12, wherein the body further includes a lower reinforcing plate.

14. The washing machine as claimed in claim 13, wherein the catching devices and the projections on the body are formed at, and projected forward from, the lower reinforcing plate.

15. The washing machine as claimed in claim 14, wherein the catching devices and the projections on the body are formed by cutting the lower reinforcing plate.

16. The washing machine as claimed in claim 6, wherein the body further includes a supporting part under each of the catching devices.

17. The washing machine as claimed in claim 16, wherein the supporting part is projected forward from the body.

18. The washing machine as claimed in claim 1, wherein the body further includes a lower reinforcing plate.

19. The washing machine as claimed in claim 1, wherein one of the one pair of the side panels includes a groove formed along a front edge thereof for receiving different wires and a circulating hose of washing water of the washing machine.

20. The washing machine as claimed in claim 19, wherein the groove is formed along the front edge of the side panel so as to be opened in a rear direction.

21. The washing machine as claimed in claim 20, wherein the groove is formed by bending a front edge of the side panel toward the opened part of the body, and therefrom toward the rear panel of the body, vertically.

22. The washing machine as claimed in claim 1, wherein the front panel includes fluidity prevention means for guiding the front panel to a required position in the front part of the body, and fastened to the body after the front panel is mounted on the body, when the front panel is rotatably engaged with the body, and mounted on the front part of the body by rotating the front panel.

23. The washing machine as claimed in claim 22, wherein the fluidity prevention means is backward projections of parts of opposite vertical edges of the front panel.

24. The washing machine as claimed in claim 23, wherein each of the side panels includes a guide part projected backward from a part of the front edge in correspondence to the fluidity prevention means.

25. The washing machine as claimed in claim 1, wherein the front panel includes;

side flanges formed by bending opposite edges to have openings toward a central part, and a reinforcing bracket fixed to the side flanges.

26. The washing machine as claimed in claim 25, wherein the reinforcing bracket includes at least one projection at each of opposite ends for fastening to the side flanges on the front panel.

27. The washing machine as claimed in claim 26, wherein the side flange includes a cut away part for passing the first projection on the reinforcing bracket.

28. The washing machine as claimed in claim 27, wherein the side flange further includes fastening holes in an upper part or a lower part for fastening the first projection on the reinforcing bracket thereto.

29. The washing machine as claimed in claim 28, wherein the reinforcing bracket is fastened with a screw or a second projection projected backward from the first projection to insert into respective fastening holes.

30. The washing machine as claimed in claim 28, wherein the side flange further includes a depth of recess around the fastening hole, and the bracket is fastened with a flat head screw.

31. The washing machine as claimed in claim 30, wherein the reinforcing bracket is fastened with a flat head screw which is not projected to rear of the side flange of the front panel.

32. The washing machine as claimed in claim 25, wherein front panel further includes an elastic member between a rear surface thereof and the reinforcing bracket for prevention of vibration of the bracket.

33. The washing machine as claimed in claim 32, wherein the elastic member is formed of sponge or rubber.

34. The washing machine as claimed in claim 1, wherein the front panel includes;

upper, and lower flanges respectively having upper edge and lower edge bent to have openings in a central direction, and reinforcing beads formed at least one of the upper and lower flanges.

35. The washing machine as claimed in claim 1, wherein the front panel further includes fastening means for fastening the projections.

36. The washing machine as claimed in claim 1, wherein the body further includes an upper reinforcing plate mounted on the upper part of the front part thereof.

37. The washing machine as claimed in claim 1, wherein the projection of the body is formed by cutting the upper reinforcing plate.

38. The washing machine as claimed in claim 37, wherein the upper reinforcing plate has a channel section.

* * * * *